United States Patent [19]

Iwamoto et al.

[11] Patent Number: 4,542,953

[45] Date of Patent: Sep. 24, 1985

[54] WIRE CONNECTION TERMINAL STAGE FOR ELECTRIC APPARATUS

[75] Inventors: Kazumasa Iwamoto, Ashiya; Naoki Mabuchi, Takatsuki; Junji Kawano, Osaka, all of Japan

[73] Assignee: Idec Izumi Corporation, Osaka, Japan

[21] Appl. No.: 594,007

[22] Filed: Mar. 27, 1984

[30] Foreign Application Priority Data

Apr. 1, 1983 [JP] Japan ..... 58-58406
Apr. 11, 1983 [JP] Japan ..... 58-63422

[51] Int. Cl.[4] ..... H01R 9/24

[52] U.S. Cl. ..... 339/198 GA; 359/198 H; 359/198 R; 359/263 R

[58] Field of Search ..... 339/198 H, 198 G, 198 R, 339/198 GA, 263 R, 222

[56] References Cited

U.S. PATENT DOCUMENTS

| | | | |
|---|---|---|---|
| 2,397,102 | 3/1946 | Graham | 339/198 G |
| 2,748,365 | 5/1956 | Speck | 339/198 H |
| 2,990,534 | 6/1961 | Nielsen | 339/198 GA |
| 3,259,876 | 7/1966 | Norden | 339/198 GA |
| 3,482,206 | 12/1969 | Jackson et al. | 339/198 R |
| 3,800,269 | 3/1974 | Palombella | 339/198 R |
| 3,904,266 | 9/1975 | Fitzpatrick | 339/198 R |
| 4,040,711 | 8/1977 | Waddington et al. | 339/198 R |
| 4,099,826 | 7/1978 | Mazzeo et al. | 339/198 R |

FOREIGN PATENT DOCUMENTS

| | | | |
|---|---|---|---|
| 1060954 | 7/1959 | Fed. Rep. of Germany | 339/198 GA |
| 1205732 | 2/1960 | Italy | 339/198 G |
| 0301919 | 9/1954 | Switzerland | 339/198 R |

OTHER PUBLICATIONS

Bulletin 1492 Terminal Blocks price sheet, Nov. 1, 1961 by "A-B Quality".

*Primary Examiner*—Gil Weidenfeld
*Assistant Examiner*—Thomas M. Kline
*Attorney, Agent, or Firm*—Pollock, Vande Sande & Priddy

[57] ABSTRACT

In a terminal stage for connecting a wire terminal thereto for use in an electrical apparatus comprising an electrically conductive terminal plate having at least two threaded holes at least two terminal screws to be screwed in the respective threaded holes, and an electrically insulating supporting member having a first wall portion substantially perpendicular to the terminal plate and for supporting the terminal plate, there are provided at least two movable members each being movable in the direction substantially perpendicular to the terminal plate and each having a first portion extending in the direction substantially parallel to the terminal plate and supporting the terminal screws, a second portion formed integrally with the first portion substantially perpendicularly to the terminal plate, and a third portion integrally formed with the second portion and extending in the direction substantially parallel to the terminal plate, each of the movable members being adapted to be stably held in at least one predetermined position by an elastic member provided in the vicinity of a central portion of the first wall portion.

12 Claims, 17 Drawing Figures

A'
A
P
8X

A
A'
12
13
10
101
9
91
61
4
63'
68
104
41
14
L
L'

WIRE CONNECTION TERMINAL STAGE FOR ELECTRIC APPARATUS

The present invention relates to a wire terminal connector for an electric apparatus and, more particularly, to a wire connection terminal stage for an electric apparatus.

Conventionally, when an electric wire provided with a solderless terminal was connected to a wire connection terminal stage in an electric apparatus, it was necessary that a terminal screw was once removed from a terminal plate of the terminal stage and attached again after the solderless terminal was disposed on the terminal plate. Further, also when such a solderless terminal was removed from the terminal connecting portion, it was necesary to remove the terminal screw from the terminal plate so that the operation of the connecting or removing the terminal screw was very troublesome and the terminal screw may be missed during the connecting/removing operation.

In order to prevent the missing of the terminal screw, a conventional wire connection terminal stage is arranged such that a movable member supporting a wire terminal fixing screw and slidably supported while intersecting a terminal plate is always biased in the direction (outward) to keep the movable member away from the terminal plate by means of a helical spring or the like.

In such a wire connection terminal stage employing a helical spring or the like as described above, however, the movable member is always urged outward by the helical spring so that when the terminal screw is screwed in the female threaded hole to fix a wire terminal, it is necessary to fix the wire terminal while pushing the terminal screw against the return force of the helical spring, resulting in a disadvantage that when numbers of wire connection terminal stages are collectively provided, the work is very troublesome because it is necessary to fix numbers of wire terminals one by one against the return force of the respective helical spring.

An object of the present invention is to provide a wire connection terminal stage in which the disadvantage in the prior art can be eliminated, the missing terminal screw can be prevented, and wire connecting-/removing work can be easily surely performed.

The above and other objects, features and advantages of the present invention will be apparent from the following detailed description of preferred embodiments thereof taken in conjunction with the accompanying drawings, in which.

Figure 1:
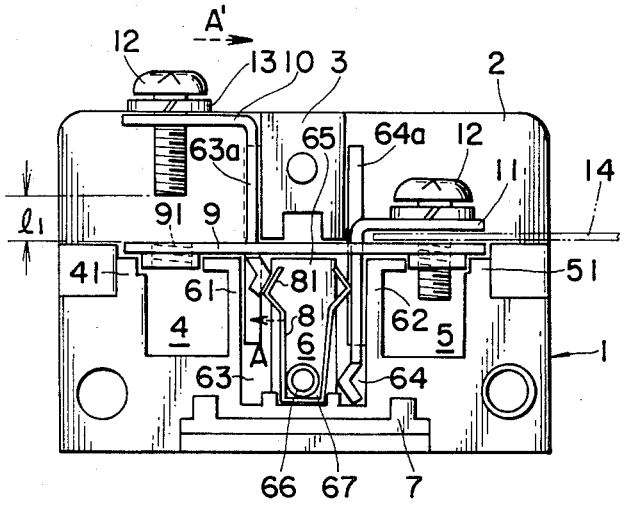
FIG. 1 is a front view of the wire connection terminal stage of a first embodiment of the present invention.

Referring to the drawings, preferred embodiments of the present invention will be described hereunder.

Figure 2:
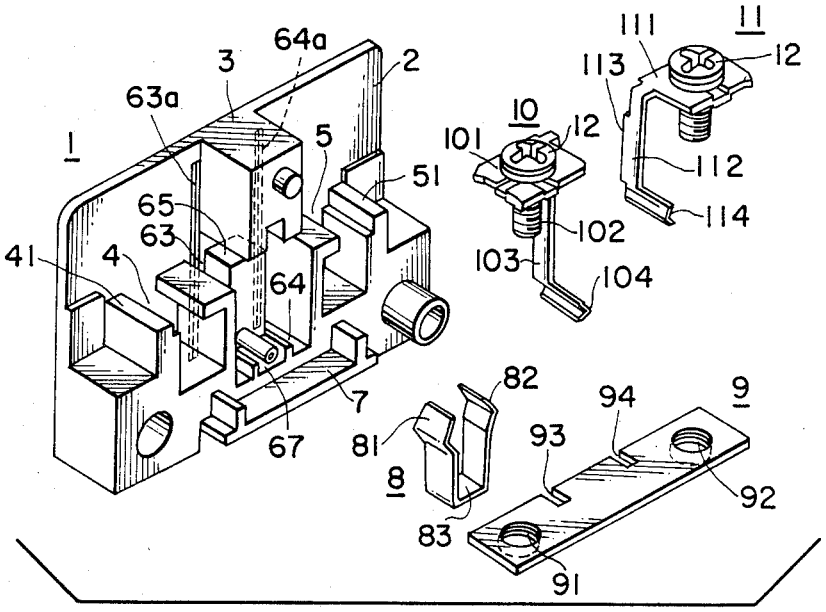
FIG. 2 is an exploded perspective view of the terminal stage of FIG. 1.
Figure 3:
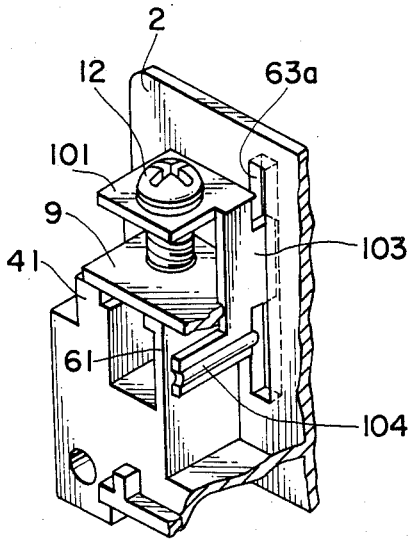
FIG. 3 is a partially broken perspective view of the terminal stage of FIG. 1.
Figure 5:
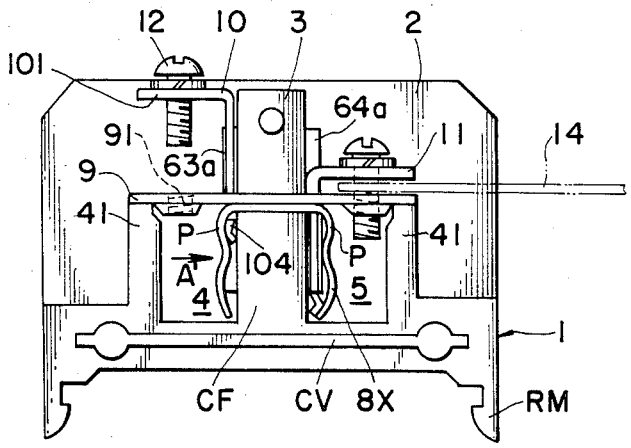
FIG. 5 is a front view of a second embodiment of the present invention.

Referring to FIGS. 1 to 3, and FIGS. 4A to 4C, a terminal stage body 1 is integrally molded with a plastic material and includes a partition portion or wall 2 for surely defining electrical insulation between the terminal stage and another terminal stage disposed adjacent the terminal stage in question, a central separation wall 3 dividing the partition portion 2 into two, left and right, portions, left and right side chambers 4 and 5 provided at the opposite, left and right, sides of the partition portion 2 respectively, a central chamber 6 provided at the lower portion of the separation wall 3, left and right end pedestals 41 and 51 defining part of the chambers 4 and 5 respectively, left and right side walls 61 and 62 defining the central chamber 6, a seat 65 slightly forwardly projected and having a transverse width in which vertically extending grooves 63 and 64 are formed between the seat 65 and the left and right side walls 61 and 62 respectively in the central chamber 6, slit grooves **63*a* and 64*a* upwardly extending from the vertical grooves 63 and 64 respectively, a groove 67 formed between a forwardly projecting cylindrical protrusion 66 and a bottom wall of the chamber 6, a protrusion 7 for the use of connection of the terminal stage with another terminal stage to be coupled adjacent the terminal stage in question, a recessed portion (not-shown) formed at the rear of the protrusion 7, etc. An elastic member 8 is constituted by a generally U-shaped metal plate and has a bottom portion 83 and a pair of leg portions respectively extending from the opposite ends of the bottom portion and respectively provided with outwardly projecting V-shaped expansion portions 81 and 82. The bottom portion 83 is fitted in the groove 67 so that the U-shaped member 8 is attached at a predetermined position in the central chamber 6. A terminal plate 9 is constituted by a rectangular electrically conductive flat plate and formed with female threaded holes 91 and 92 at the left and right end portions thereof. The terminal plate 9 is further formed with a pair of slots 93 and 94 which are to be disposed to face the partition wall 2 with movable members 10 and 11 slidably received in the slots 93 and 94 respectively. The terminal plate 9 is supported by the central chamber 6 and the pedestals 41 and 51. The movable members 11 and 12 are made to be symmetric and have horizontally extending wire terminal pressing portions 101 and 111 respectively. A terminal screw 12 formed with a comming-off preventing portion and a spring washer 13 are rotatably supported in a hole formed at a central portion of each of the terminal pressing portions 101 and 111. The movable members 11 and 12 respectively have leg portions 102 and 112 vertically downwardly extending from the terminal pressing portions 101 and 111, which have middle portions slightly outwardly projected to form guide portions 103 and 113 slidably fitted into the slit grooves 63*a* and 64*a* respectively, and V-shaped foot portions 104 and 114 substantially horizontally extending from the respective lower ends of the vertically extending leg portions 102 and 112 respectively. FIG. 3 shows the movable member 10 with the guide portion 103 fitted in the slit groove 63*a***.

These movable members 10 and 11 are attached to the terminal stage body 1 in such a manner that they are put in the position symmetrical with each other as shown in FIG. 2, and are pushed together with the terminal plate 9 from the front side of the terminal stage body 1 under the condition that the leg portions 102 and 112 are respectively fitted in the slots 93 and 94 of the terminal plate 9.

At the left side in FIG. 1, shown in the state in which no wire is connected and in which the lower end foot portion 104 of the movable member 10 is in its upper limit position where it rides on the upper surface portion of the V-shaped expansion portion 81 of the elastic member 8 and in contact with the terminal plate 9. Under the condition, the elastic force of the elastic member 8 acts in the direction indicated by an arrow A so that the movable member 10 is somewhat slanted toward A'. Thus, the movable member 10 is prevented from falling down outward, that is toward A. Under this condition, the terminal screw 12 does not come off from the terminal pressing portion 101 of the movable member 10 and the tip end of the terminal screw 12 faces the female threaded hole 91 with a distance $l_1$ maintained between the tip end of the terminal screw 12 and the upper surface of the terminal plate 9. The state where a wire 14 is connected is shown at the right side in FIG. 1. The wire terminal is sandwiched between the terminal plate 9 and the terminal pressing portion 111 and the movable member 11 is put at its lower limit position.

Figures 4A, 4B, 4C, 7A, 7B, 7C:
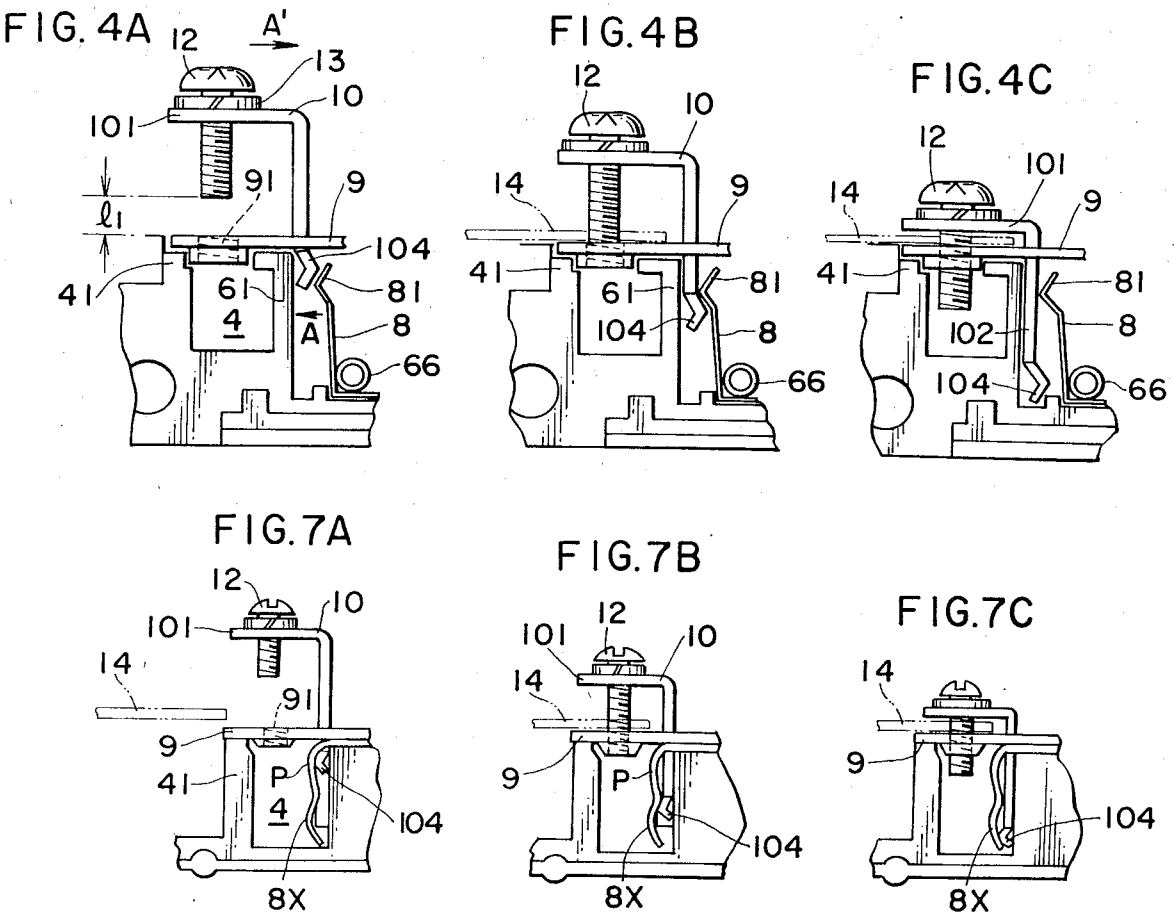
FIGS. 4A, 4B and 4C are diagrams for explaining the operation of the first embodiment.
FIGS. 7A, 7B and 7C are diagrams for explaining the operation of the second embodiment.
Figure 6:
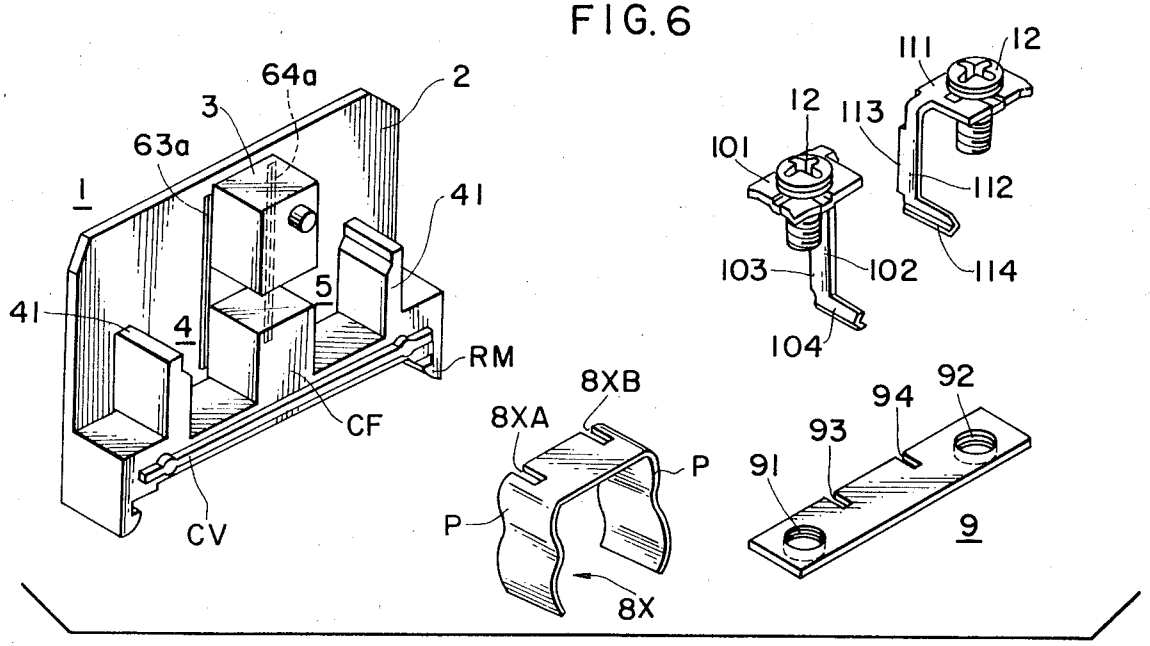
FIG. 6 is an exloded perspective view of the terminal stage of FIG. 5.
Figure 8:
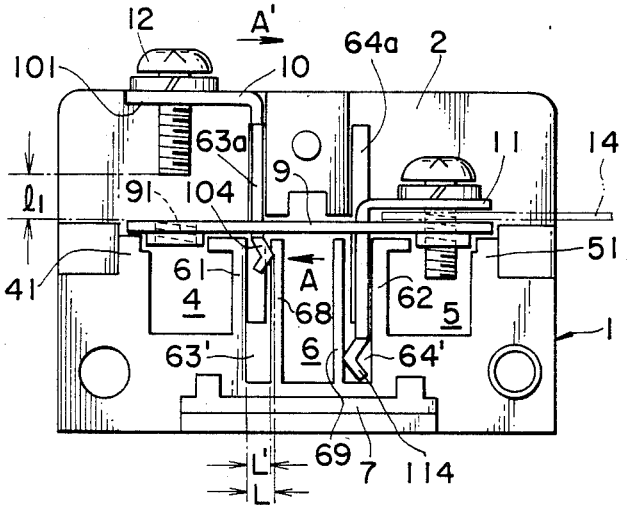
FIG. 8 is a front view of a third embodiment of the present invention.
Figure 9:
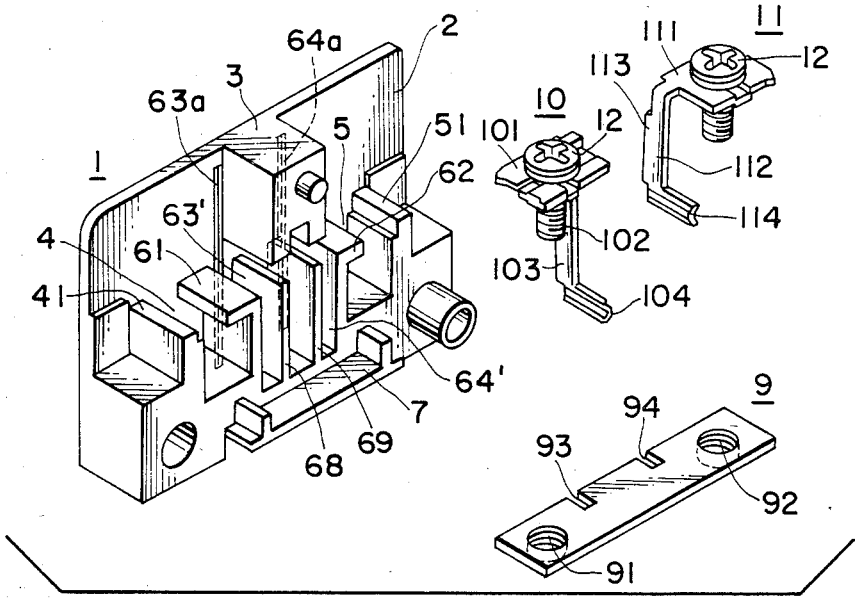
FIG. 9 is an exploded perspective view of the terminal stage of FIG. 8.

The terminal stage according to the present invention has a feature that the movable member has two kinds of stable positions in the state where no wire is connected to the movable member. That is, as shown in FIG. 4A, the movable member 10 is stably held at a first stable position where the V-shaped foot portion 104 of the movable member 10 rides on the upper side surface of the V-shaped expansion portion 81 of the elastic member 8 since the V-shaped foot portion 104 is urged by the V-shaped expansion portion 81 toward the left side wall 61, that is in the direction A. Further, if the movable member 10 is pressed down from the first stable position of the movable member 10 shown in FIG. 4A, the foot portion 104 comes down over the V-shaped expansion portion 81 to a second stable position of the movable member 10 where the V-shaped foot portion 104 rests on the lower side surface of the V-shaped expansion portion 81 and the movable member 10 is stably held in the same manner as described above.

Thus, when the worker inserts a wire 14 between the terminal screw 12 and the terminal plate 9 and pushes down the movable member 10 in the first stable position shown in FIG. 4A, the movable member 10 is readily displaced to the second stable position shown in FIG. 4B where the worker can readily fasten the screw 12. As the screw 12 comes down, the guide portion 103 slides down along the slit groove **63*a* because it is fitted in the slit groove 63*a* and reaches the position as shown in FIG. 4C. During the fastening operation of the terminal screw 12, the movable member is not affected by the elastic member 8** so that the screw fastening work can be readily performed.

As the material for the elastic member, any suitable elastic material other than a metal material, such as a plastic material, may of course be used.

Next, reference is made to FIGS. 5, 6, 7A, 7B and 7C. The same reference numerals as used in FIGS. 1 and 2 are used in these figures to designate the same or corresponding components or elements.

A stage seat CF is projected from a partition portion 2 so that an elastic member 8X can be supported on the seat CF. A projecting portion CV is provided for adjacently connecting the terminal stage in question to another terminal stage. A rail attachment portion RM is provided for attaching the terminal stage onto a support rail. The elastic member 8X is made of a substantially inverted-U-shaped metal material and has outward-expansion portions P and P formed at its respective leg portions and slots 8XA and 8XB formed in the top portion connecting the respective leg portions for fitting movable members 10 and 11 in the slots 8XA and 8XB respectively. The movable members 10 and 11 are attached to the terminal stage in such a manner that they are put in the position symmetrical with each other as shown in FIG. 2, and are pushed together with the terminal plate 9 and the elastic member 8X into the space between a central separation wall 3 and the stage seat CF, from the front side of the terminal stage body 1 with vertically extending leg portions 102 and 112 of the movable members 10 and 11 respectively fitted in the slots 93 and 94 of the terminal plate 9 as well as in the slots 8XA and 8XB respectively.

Next, the operation of the movable members 10 and 11 will be described hereunder. The movable member 10 is held at a first stable position where the lower end foot portion 104 of the movable member 10 is sandwiched between outward expansion portion P of the elastic member 8X and the stage seat CF. Further, if the movable member 10 is pressed down from its first stable position, the lower end foot 104 portion comes down over the inward projecting portion under the outward projecting portion to a second stable position of the movable member 10 where the lower end foot portion 104 rests on the lower side surface of the inward projecting portion and the movable member 10 is stably held in its second stable position as shown in FIG. 7B. A wire terminal 14 is inserted between a terminal screw 12 and the terminal plate 9 in the first stable position shown in FIG. 7A and the movable member 10 is pushed down. The movable member 10 is readily displaced to the second stable position shown in FIG. 7B where the terminal screw 12 is fastened. As the terminal screw 12 comes down, the movable member 10 slides down along the slit groove **63*a* because the guide portion 103 of the movable member 10 is fitted in th slit groove 63*a***.

As the material for the elastic member 8X, any suitable elastic material other than a metal material, such as a plastic material, may of course be used, similarly to the first embodiment.

Figures 10A, 10B, 10C:
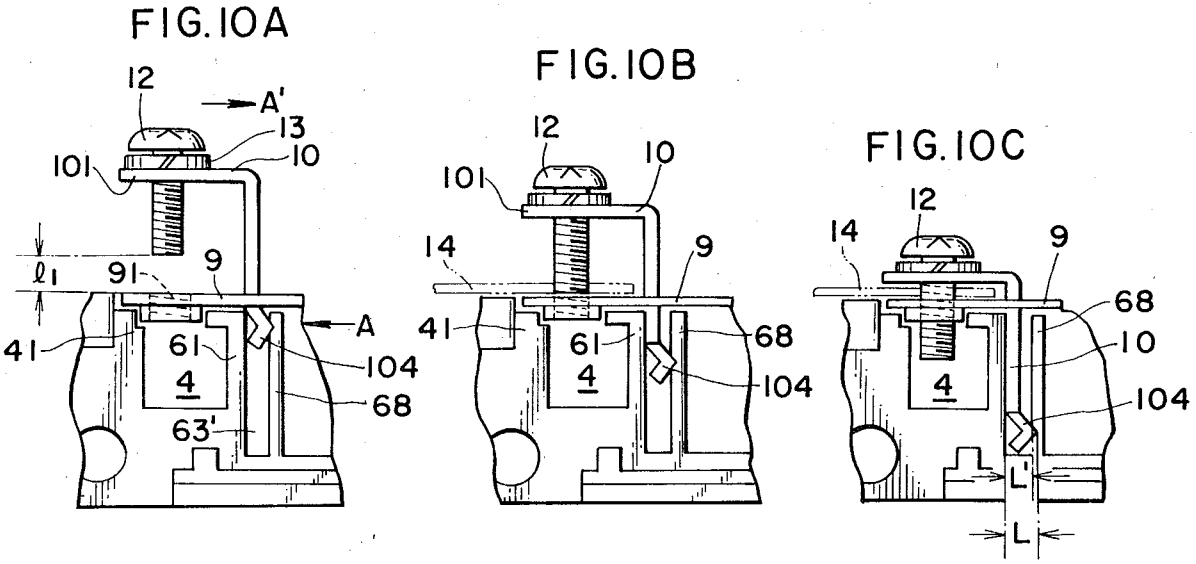
FIGS. 10A, 10B and 10C are diagrams for explaining the operation of the third embodiment.

Next, reference is made to FIGS. 8, 9, 10A, 10B and 10C to describe a third embodiment. The same numerals as that used in the first and second embodiments are used in the third embodiment to designate the same or coresponding components or elements. The third embodiment is featured in by elastic walls 68 and 69 formed integrally with a terminal stage body 1. A movable membe 10 is supported between a left side wall 61 and the elastic wall 68 while another movable member 11 is supported between a right side wall 62 and the elastic wall 69. That is, in a central chamber 6, the elastic walls 68 and 69 are separated from the left side wall 61 and the right side wall 62 respectively to form spaces 63' and 64' therebetween respectively. The width L of a lower end foot portios 104 (114) of the movable members 10 (11) is made slightly larger than the distance L' between the wall 61 (62) and the elastic wall 68 (69) and the movable member 10 (11) is vertically slidably attached to the terminal stage body 1 in such a manner that the lower end foot portion 104 (114) is sandwiched between the walls 61 and 68 (62 and 69). Each of the movable members 10 and 11 may be held in a first and a second stable position shown in FIGS. 10A and 10B respectively. FIG. 10C shows the state in which a wire 14 is connected in the terminal stage.

Figure 11:
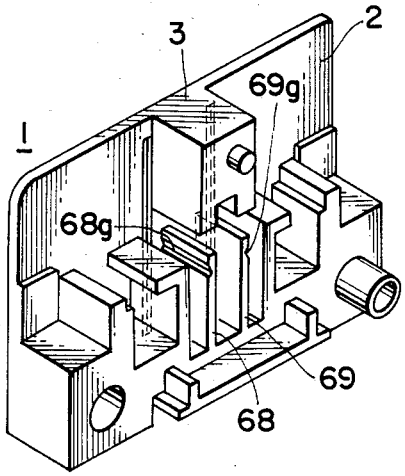
FIG. 11 is a perspective view showing a modification of the third embodiment.

FIG. 11 shows a modification of the third embodiment. That is, grooves 68*g* and 69*g* are formed in the elastic walls 68 and 69 respectively. These grooves 68*g* and 69*g* receive the lower end foot portions 104 and 114 respectively when the movable membes 10 and 11 are in the first stable position to thereby obtain a further stable condition of each of the movable members 10 and 11.

We claim:

1. A terminal stage for connecting a wire terminal thereto for use in an electrical apparatus having an electrically conductive terminal plate having at least two threaded holes at least two terminal screws to be screwed in said respective threaded holes, and an electrically insulating supporting member having a first wall portion substantially perpendicular to said terminal plate and supporting said terminal plate, comprising:

(a) at least two second wall portions integrally formed with said first wall portion, and in contact with said terminal plate, separated from each other, and extending in the direction substantially perpendicular to said first wall portion and said terminal plate;

(b) a substantially U-shaped elastic member mounted between said at least two wall portions and having two elastic portions extending in the direction substantially perpendicular to said terminal plate and being opposed to each other; and (c) at least two movable members each being movable in the direction substantially perpendicular to said terminal plate and each having a first portion extending in the direction substantially parallel to said terminal plate and supportring said terminal screws, a second portion formed integrally with said first portion substantially perpendicularly to said terminal plate, and a third portion integrally formed with said second portion and extending in the direction substantially perpendicular to said first wall portion and substantially parallel to said terminal plate, said second and third portions of each of said movable members being movable between said second wall portion and said elastic wall portion of said elastic member in the direction substantially perpendicular to said terminal plate, each of said terminal screws being stably held in at least one predetermined position spaced from said terminal plate by a predetermined distance.

2. A terminal stage as set forth in claim 1, in which each of said terminal screws is adapted to be selectively stably held at a first stable position spaced from said terminal plate by a first distance and at a second stable position spaced from said terminal plate by a second distance.

3. A terminal stage as set forth in claim 1, in which said elastic member is comprised of a metal plate.

4. A terminal stage as set forth in claim 1, further comprising projecting portions integrally formed with said second portions of said respective movable members and projecting in the direction substantially perpendicular to said first wall portion, and first slit grooves formed in said first wall portion and extending between said second wall portion and said elastic member in the direction substantially perpendicular to said terminal plate, said first slit grooves respectively slidably supporting said projecting portions of said respective movable members.

5. A terminal stage for connecting a wire terminal thereto for use in an electrical apparatus having an electrically conductive terminal plate having at least two threaded holes at least two terminal screws to be screwed in said rspective threaded holes, and an electrically insulating supporting member having a first wall portion substantially perpendicular to said terminal plate and supporting said terminal plate, comprising:

(a) an electrically insulating projecting portion integrally formed with said first wall portion in the vicinity of a central portion of said first wall portion and projecting in the direction substantially perpendicular to said first wall portion;

(b) a substantially inverted-U-shaped elastic member supported by said insulating projecting portion and having two elastic portions extending in the direction substantially perpendicular to said terminal plate and being opposed to each other; and (c) at least two movable members each being movable in the direction substantially perpendicular to said terminal plate and each having a first portion extending in the direction substantially parallel to said terminal plate and supporting said terminal screws, a second portion formed integrally with said first portion substantially perpendicularly to said terminal plate, and a third portion integrally formed with said second portion and extending in the direction substantially perpendicular to said first wall portion and substantially parallel to said terminal plate, said second and third portions of each of said movable members being movable between said elastic wall portion of said elastic member and said insulating projecting portion in the direction substantially perpendicular to said terminal plate, each of said terminal screws being stably held in at least one predetermined position spaced from said terminal plate by a predetermined distance.

6. A terminal stage as set forth in claim 5, in which each of said terminal screws is adapted to be selectively stably held at a first stable position spaced from said terminal plate by a first distance and at a second stable position spaced from said terminal plate by a second distance.

7. A terminal stage as set forth in claim 5, in which said elastic member is comprised of a metal plate.

8. A terminal stage as set forth in claim 5, further comprising projecting portions integrally formed with said second portions of said respective movable members and projecting in the direction substantially perpendicular to said first wall portion, and first slit grooves formed in said first wall portion and extending between said insulating projecting portion and said elastic member in the direction substantially perpendicular to said terminal plate, said first slit grooves respectively slidably supporting said projecting portions of said respective movable members.

9. A terminal stage for connecting a wire terminal thereto for use in an electrical apparatus having an electrically conductive terminal plate having at least two threaded holes at least two terminal screws to be screwed in said respective threaded holes, and an electrically insulating supporting member having a first wall portion substantially perpendicular to said terminal plate and for supporting said terminal plate, comprising:

(a) at least two second wall portions integrally formed with said first wall portion, made in contact with said terminal plate, separated from each other, and extending in the direction substantially perpendicular to said first wall portion and said terminal plate;

(b) two third elastic members spaced from each other, formed integrally with said first wall portion, disposed between said second wall portions, and extending substantially parallelly with said second wall portions; and (c) at least two movable members each being movable in the direction substantially perpendicular to said terminal plate and each having a first portion extending in the direction substantially parallelly to said terminal plate and supporting said terminal screws, a second portion formed integrally with said first portion substantially perpendicular to said terminal plate, and a third portion integrally formed with said second portion and extending in the direction substantially perpendicular to said first wall portion and substantially parallel to said terminal plate, said second and third portions of each of said movable members being movable between said second wall portion and said third elastic wall portion in the direction substantially perpendicular to said terminal plate, each of said terminal screws being stably held in at least one predetermined position spaced from said terminal plate by a predetermined distance.

10. A terminal stage as set forth in claim 9, in which each of said terminal screws is adapted to be selectively stably held at first stable position spaced from said terminal plate by a first distance and at a second stable position spaced from said terminal plate by a second distance.

11. A terminal stage as set forth in claim 9, further comprising projecting portions integrally formed with said second portions of said respective movable members and projecting in the direction substantially perpendicular to said first wall portion, and first grooves formed in said first wall portion and extending between said second wall portion and said third elastic wall portion in the direction substantially perpendicular to said terminal plate, said first grooves respectively slidably supporting said projecting portions of said respetive movable members.

12. A terminal stage as set forth in claim 10, in which each of said third elastic wall portion is formed with a second groove for receiving said third portion of each of said movable members in said first stable position of said movable member.

* * * * *